US005458926A

United States Patent [19]

VerMehren

[11] Patent Number: 5,458,926

[45] Date of Patent: Oct. 17, 1995

[54] GUMMER ROLL APPARATUS

[76] Inventor: H. Richard VerMehren, 3865 N. Palafox St., Pensacola, Fla. 32505

[21] Appl. No.: 203,888

[22] Filed: Mar. 1, 1994

Related U.S. Application Data

[60] Continuation of Ser. No. 933,384, Aug. 21, 1992, abandoned, which is a division of Ser. No. 494,679, Mar. 16, 1990, abandoned.

[51] Int. Cl.[6] ..... B05D 1/28

[52] U.S. Cl. ..... 427/428; 427/207.1; 118/248; 118/262; 118/244

[58] Field of Search ..... 427/428, 207.1; 118/248, 262, 244

[56] References Cited

U.S. PATENT DOCUMENTS

| | | | |
|---|---|---|---|
| 2,039,335 | 5/1936 | Nall | 270/40 |
| 2,354,825 | 8/1944 | Novick | 93/62 |
| 2,748,675 | 6/1956 | Affelder | 93/62 |
| 2,956,484 | 10/1960 | Subklew | 93/61 |
| 3,285,169 | 11/1966 | Hartwig | 101/207 |
| 3,303,814 | 2/1967 | Nitchie | 118/249 |
| 3,367,249 | 2/1968 | Hornung | 93/61 |
| 3,372,861 | 3/1968 | Johnson et al. | 229/80 |
| 3,400,641 | 9/1968 | Stemmler | 93/61 |
| 3,408,908 | 11/1968 | Berkowitz | 93/61 |
| 3,450,009 | 6/1969 | Dohnalik | 93/62 |
| 3,510,052 | 5/1970 | Ruda | 493/214 |
| 3,604,318 | 9/1971 | Winkler | 93/74 |
| 3,733,982 | 5/1973 | Manolis | 493/212 |
| 3,768,438 | 10/1973 | Kumpf | 118/262 |
| 3,869,965 | 3/1975 | Howatt | 93/61 A |
| 3,906,844 | 9/1975 | Gougeon | 93/61 B |
| 3,957,570 | 5/1976 | Helm | 156/519 |
| 3,980,006 | 9/1976 | Welch | 93/61 R |
| 3,990,354 | 11/1976 | Ward et al. | 93/62 |
| 4,046,931 | 9/1977 | Innes et al. | 427/428 |
| 4,114,520 | 9/1978 | Achelpohl et al. | 93/33 X |
| 4,126,948 | 11/1978 | VerMehren | 34/150 |
| 4,138,933 | 2/1979 | Helm | 93/61 R |
| 4,160,500 | 7/1979 | VerMehren | 198/457 |
| 4,210,318 | 7/1980 | VerMehren | 270/79 |
| 4,249,984 | 2/1981 | VerMehren | 156/552 |
| 4,257,514 | 3/1981 | VerMehren | 198/459 |
| 4,357,896 | 11/1982 | Feldkamper | 118/262 |
| 4,379,730 | 4/1983 | Anderson | 118/262 |
| 4,443,211 | 4/1984 | Wooley | 493/188 |
| 4,514,182 | 4/1985 | VerMehren . | |
| 4,624,408 | 11/1986 | VerMehren | 229/69 |
| 4,642,085 | 2/1987 | Helm | 493/222 |
| 5,045,040 | 9/1991 | Vetter | 493/194 |
| 5,112,291 | 5/1992 | VerMehren | 493/409 |
| 5,176,611 | 1/1993 | VerMehren . | |

FOREIGN PATENT DOCUMENTS

| | | |
|---|---|---|
| 878245 | 8/1971 | Canada . |
| 216643 | 6/1983 | Germany . |

*Primary Examiner*—Shrive Beck
*Assistant Examiner*—David M. Maiorana
*Attorney, Agent, or Firm*—Heller & Kepler

[57] ABSTRACT

A gumming roll preferably for use with apparatus for applying gum to blanks and pertains, has rollers in skidding contact for returning excess adhesive to an adhesive pan without substantial foaming of the adhesive.

17 Claims, 3 Drawing Sheets

GUMMER ROLL APPARATUS

RELATED APPLICATIONS

This application is a continuation of Ser. No. 07/933,384, filed Aug. 21, 1992, which is a divisional of Ser. No. 07/494,679, filed Mar. 16, 1990, both abandoned.

BACKGROUND OF THE INVENTION

The present invention relates in general to a gumming roll apparatus for applying gum to blanks and pertains, more particularly, to an apparatus for applying gum to envelopes during continuous processing and operation of a gumming machine. The roller combination of this invention is an improvement over the conventional low speed gumming station roller combination.

With the conventional gumming roll apparatus a gumming station is typically one of a number of stations in an envelope processing apparatus or other continuous processing apparatus. For example, it is common to provide a gumming station in a conventional envelope making machine or in apparatus intended to apply gum (e.g., a self-sealing latex adhesive) to envelopes already formed and processed solely for the purpose of applying a desired adhesive.

Self-sealing envelopes typically require cooperating adhesive deposits applied to both a flap and an enclosure portion of an envelope. The envelope is gummed in order that a sealed envelope will be formed when the adhesive carrying portions are pressed together. It will be understood that other articles, forms, or enclosures may be processed in an equivalent manner.

The conventional gumming stations typically satisfy the operational requirements with a combination gum box, roller for transferring the gum or adhesive to one or more gummer pads on a gummer roll. The conventional apparatus includes the gum box or trough for supplying the adhesive of choice, one or more intermediate transfer rollers for transferring the adhesive to the adhesive application roller.

These conventional roller arrangements provide for the physical transfer of the adhesive as rotation of the roller carries the roller surface through the gum box and the adhesive which agitates the adhesive. Typical adhesives, particularly latex adhesives, foam or froth as a consequence of agitation.

It is a known drawback of gumming apparatus that the foam or froth may be transferred on the rollers to the envelope or other adhesive receiving portion of an article processed at the gumming station. The foam or froth creates a blemish on the adhesive which may not provide a desired adherence. It is typical to reject items with this foam or froth blemish. As a result, conventional gumming stations and apparatus have a drawback of a limited speed of operation.

The gumming station speed limitation creates an overall equipment limitation since the transfer roller must operate at a speed sufficient to transfer adhesive to the gumming roller and the latter roller rotates in a manner to provide registration between gummer pads and items passing through the gumming station.

Reducing the rotational speed of a gumming roller without reducing the processing speed or output of the gumming station would require a relatively large gumming roller circumference with a limited rotational speed in conventional apparatus. This solution has numerous drawbacks, including space limitation since the gummer station is often one of a number of stations. Another drawback associated with a larger and slower gumming roller is that the adhesive could dry out between applications of fresh adhesive from the transfer roller.

Accordingly, it is an object of the present invention to provide an improved gum roll apparatus that is adapted to increase the processing speed of a gumming station. With the roller arrangement of this invention the gumming station output of either a stand alone station or a gumming station incorporated into a larger apparatus will be increased without significant adhesive degradation due to foam or froth transferred to a workpiece from the gumming roller.

Another object of the present invention is to provide an improved gum roll apparatus that is constructed to provide a more uniform adhesive transfer with an increase in gum roller rotational speed and thus provide an increased output for an apparatus incorporating the arrangement of this invention.

A further object of the present invention is to provide an improved gum roll apparatus that is adapted for use with existing equipment. The improved roller combination of this invention may be incorporated into existing equipment with only minor timing modifications to ensure that the adhesive is applied in desired registration with the envelope flap, or the like.

Still another object of the present invention is to provide an improved gum roll apparatus that may be readily adapted for use in a gumming machine for applying adhesive to envelope flaps.

Still a further object of the present invention is to provide an improved gum roll apparatus that allows an increase in gummer cylinder rotational speed without a corresponding increase in adhesive foaming. The combination of this invention substantially eliminates adhesive or gum foaming on the gummer cylinder and associated gummer pads.

SUMMARY OF THE INVENTION

To accomplish the foregoing and other objects of this invention there is provided an gum roll apparatus and gumming roll combination for transferring adhesive from a gum box to a receiving piece, such as an envelope flap. The gum roll apparatus and gumming roll combination comprises an adhesive reservoir means and a plurality of operatively associated transfer means.

A portion of the adhesive means is transferred from the reservoir means to a workpiece. The skidding of one roller on another effectively removes and returns the adhesive to a pan without causing foam or froth in the pan at slow operating speeds and significantly reducing foaming and frothing at relatively higher operating speeds and returns excess adhesive material to the reservoir with a minimum of foaming of the adhesive in the reservoir. The transfer means may include first and second roller means.

Another roller means is in wiping contact with the first roller means. The wiping contact results in the transfer of a non-turbulent portion of the adhesive means from the first roller means to the second roller means.

A third roller means is in operative contact with the adhesive carried on the second roller means. A portion of the adhesive is transferred from the second roller means to the third roller means and then to a designated portion of the receiving piece or workpiece.

A method of the present invention includes the steps of providing an adhesive means in a container and rotating a first roller means through the adhesive means in the container. A second roller means is rotated in the opposite direction and skids over the first roller means with the second roller means returning an excess of the adhesive means to an adhesive reservoir with reduced foaming.

These and other objects and features of the present invention will be better understood and appreciated from the following detailed description of one embodiment thereof, selected for purposes of illustration and shown in the accompanying drawings.

DETAILED DESCRIPTION

Figure 1:
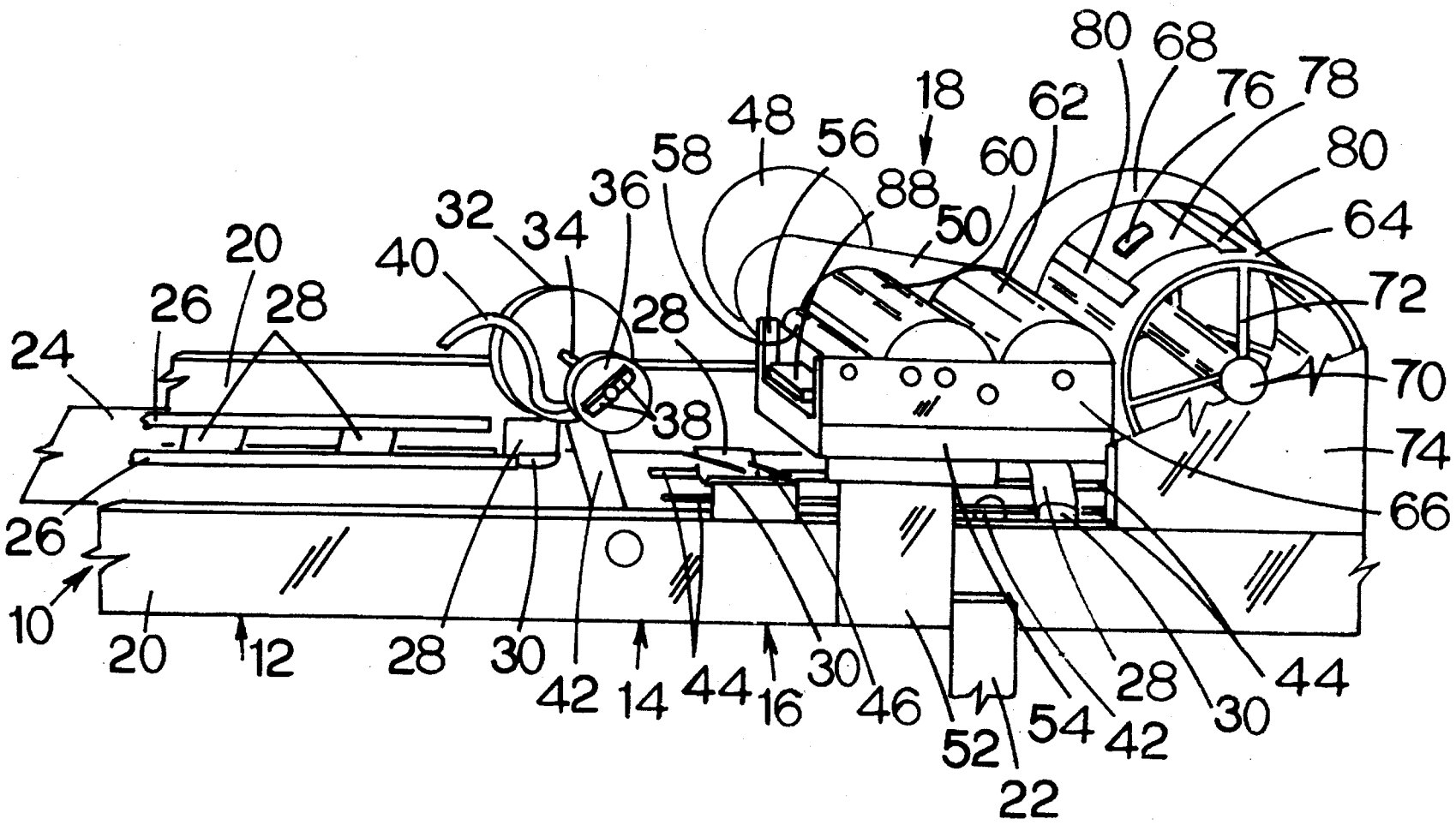
FIG. 1 is a perspective view of a schematic representation of a conventional gumming apparatus incorporating a combination of gumming rolls constructed in accordance with the present invention.

Referring now to the drawings there are shown preferred embodiments for the gum roller and gum roller combination incorporating the meter and skidding or wiping roll of this invention. The wiping roll is described in connection with an envelope making application to apply adhesive to an envelope construction. The wiper roll of the present invention is particularly adapted for providing a homogeneous adhesive layer on the envelope and is characterized by the isolation of foam or froth from the adhesive applied to the envelope.

The drawings show a conventional gumming apparatus 10 including a conveying station 12, a workpiece or envelope transfer station 14, a flap bending station 16, and a gumming station 18. The gumming apparatus includes horizontal supporting framework members 20 and vertical supporting framework members 22.

The workpiece 28, e.g., an envelope is transferred through the gumming apparatus 10 on a conventional conveyor table 24 while it is maintained in a generally flattened position by longitudinal hold down members 26 placed as required along the length of the gumming apparatus. The envelope 28 depicted in FIG. 1 includes a single gum or adhesive receiving flap 30.

The conventional transfer station 14 includes a power take off mechanism and its associated housing 32. The particular power take off will vary depending upon the method used to supply motive power to the various stations along the length of the apparatus 10. A chain drive, belt drive, or individual motors are suitable power sources. It will be understood by one skilled in the art as to how to provide the required power take off to the gumming apparatus stations.

Referring again to the transfer station 14, there is provided the drive or gear housing 32 from which extends a drive shaft 34. A support member 36 at the end of the drive shaft carries two vacuum supply outlets 38 and the vacuum is supplied from a suitable vacuum source (not shown) by a vacuum hose 40. The drive shaft rotates the outlets 38 in timed relationship with the envelopes 28 transferred through the gumming apparatus 10. A plurality of driven and non-driven transfer rollers 42 assist in the transfer and movement of the envelopes.

The transfer station moves each envelope in turn to the flap bending station 16 and into cooperative association with receiving supports 44 which guide each envelope to a flap bending member 46. In the illustrated embodiment a plough share bending device is depicted. It will be understood that other flap bending devices may be substituted.

The gumming station 18 includes a drive or gear housing 48 for the desired power take off arrangement used in a particular gumming apparatus. As will be understood from the support arrangement, the gumming station of the present invention may be removed or added to a particular gumming apparatus. If the present invention is added to an existing apparatus, then those skilled in the art will recognize and understand the timing adjustments that may be required to integrate the gumming station as an operating portion of the overall apparatus.

The drive or gear housing may also include a conventional adjustable drive or gear arrangement in order to adjust the rotational speed of the rollers (described below). Incorporation of an adjustable drive increases the flexibility of the gumming station to accommodate different operating requirements that the apparatus 10 is intended to provide.

A gear housing 50 is provided and supported on a framework that permits removal of the entire gummer station as a unit, if desired. The framework includes vertical support members 52 and horizontal support members 54. A housing support member 56 is shown for the illustrated embodiment.

The roller combination in the illustrated embodiment includes a gum (gum and adhesive are used interchangeably throughout) metering roller 58, a gum roller 60, a wiper roller 62, and a gummer cylinder 64. A roller support structure 66 provides shaft and bearing support for the rollers as required.

A gummer cylinder drive or gear housing 68 is provided for the gear, drive, or power take off arrangement provided with the particular gummer apparatus 10. In the illustrated embodiment it is considered preferred to provide a chain drive (not shown) extending the length of the apparatus 10. The chain will provide the source of power for drives at each station.

The conventional gummer cylinder includes a drive shaft 70, spoke members 72 (the spokes may not be required if the cylinder is constructed from a hollow cylinder with closed ends, not shown), and the gummer cylinder support surface or structure 74. The structure 74 carries a conventional gummer pad 76 and a flexible support sheet 78.

The flexible sheet is typically held in place with strips of tape 80. Using tape allows the pads to be moved or changed. For example, it will be noted that one gummer pad is used in FIG. 1 and two gummer pads are used in the embodiment depicted in FIG. 2 because of the different envelope being processed.

Figure 2:
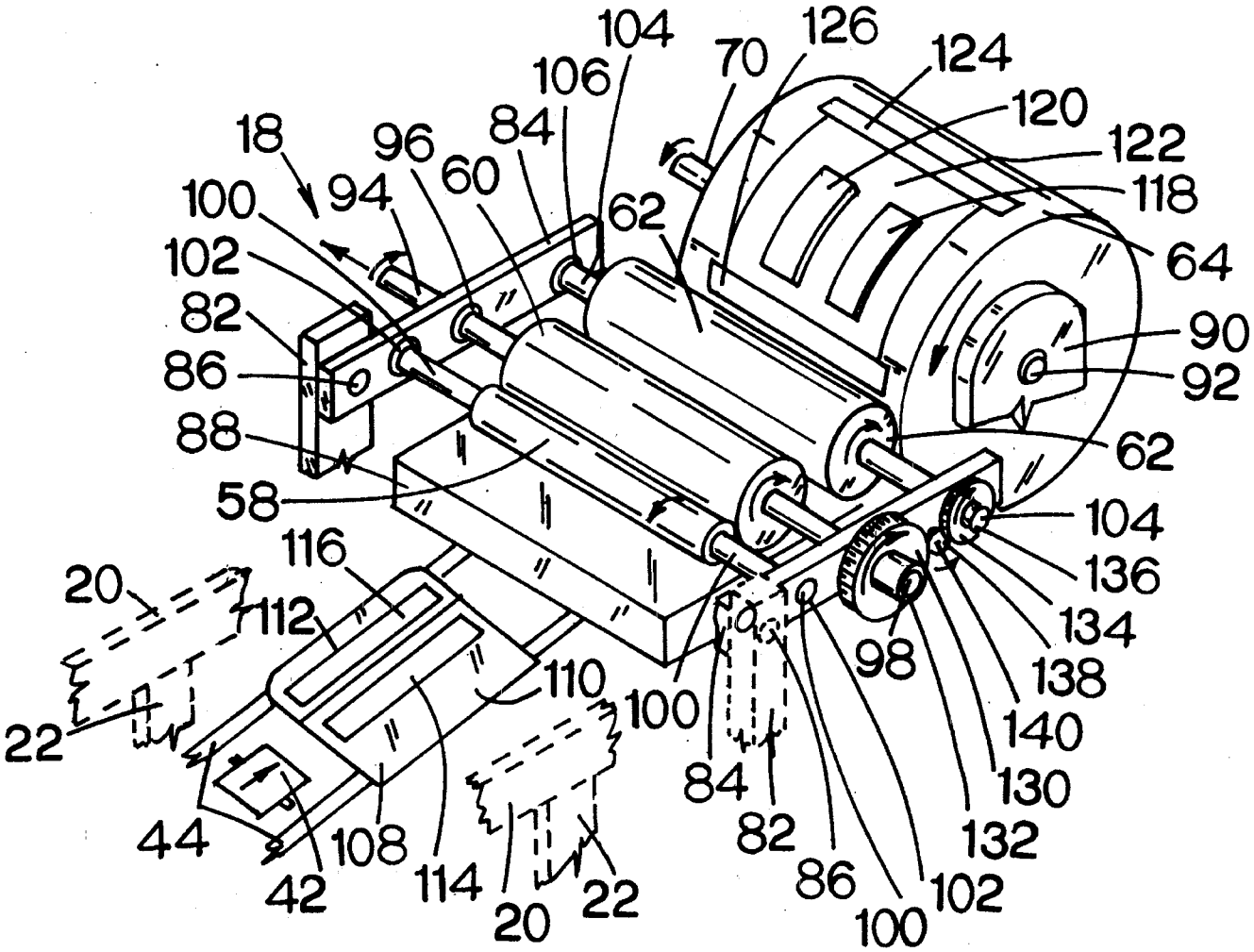
FIG. 2 is a perspective view of another schematic representation of a gumming roll combination incorporating a metering and wiping roll.
Figure 3:
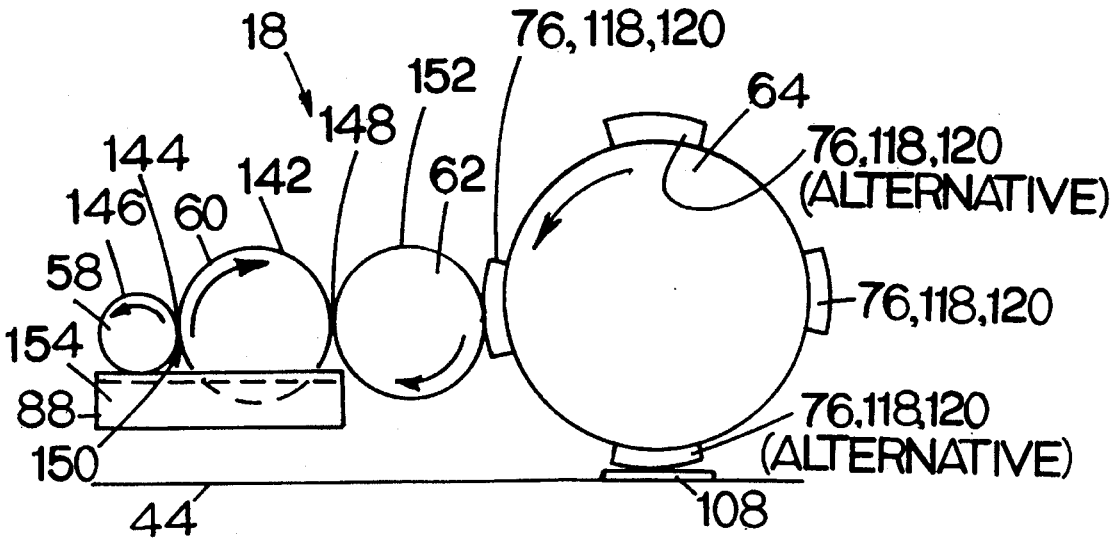
FIG. 3 is schematic elevation view of a gumming roller combination incorporating the wiping roll of this invention.

Another embodiment of the present invention is depicted in FIG. 2 and includes gummer station 18 and associated vertical support members 82 and horizontal support members 84. The horizontal members 84 can incorporate the required bearing supports for the roller support shafts. Suitable fasteners 86, such as machine bolts, hold the structure together and may be removed as required. The support structure supports an adhesive pan 88.

A gummer roll support structure 90 including necessary bearings 92 provide support for the gummer cylinder 64.

The gum and wiper roller combination 60, 62 are driven through a gum roller drive shaft 94 supported for rotation by a suitable shaft bearing 96. A shaft extension 98 extends to the support member 84. The metering roller 58 is supported for rotation by support shaft 100 and associated support shaft bearings 102. Similarly, the wiper roller 62 is supported for rotation by its associated support shaft 104 and support shaft bearing 106. Both the wiper and meter rollers are eccentrically mounted in preferred embodiment.

The gum and meter roller combination 60, 58 are driven through the gum roller drive shaft 94 supported for rotation by the shaft bearing 96.

Another workpiece 108 is illustrated and includes an enclosure portion 110 and a flap portion 112. The enclosure is illustrated as having an adhesive receiving portion 114 and the flap has an adhesive receiving portion 116. This illustrates the flexibility provided by the gummer pads that can be removed and replaced. In FIG. 2 there is shown an enclosure gummer pad 118 and a flap gummer pad 120 carried by a flexible support member 122. The support member is attached to the gummer cylinder with adhesive members 124, 126, such as lengths of adhesive tape.

A preferred embodiment of a wiper roll gear train 128 is depicted in FIG. 2 and includes a gum roller gear 130 and an associated hub 132. It will be understood that the gears can be removed and replaced in order to allow a change in the gear ratios and rotational speed of the rollers. Likewise, the rollers can be changed if desired or required. A wiper roller gear 134 and an associated hub 136 are eccentrically supported by structural support member 84 in a preferred embodiment.

An intermediate gear 138 provides for the gum roller and the wiper roller to rotate in the same direction and opposite to the gummer cylinder. The intermediate gear includes an associated support shaft and hub combination 140.

Figure 4:
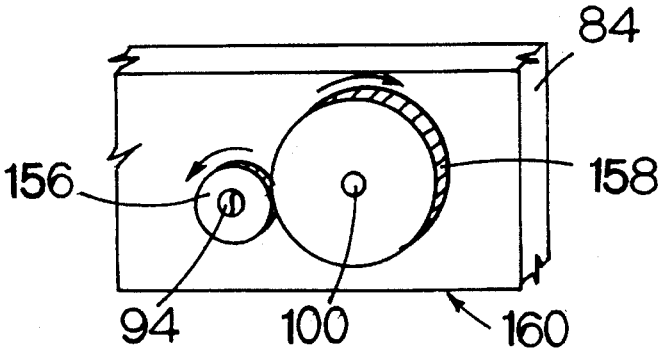
FIG. 4 is a schematic elevation view of another side of the apparatus depicting a schematic diagram of another gear train.

A preferred embodiment of a meter roll gear train 160 is depicted in FIG. 4 and includes a drive shaft gear 156 and a metering roller support shaft gear 158. In a preferred embodiment the gear 158 can be removed and it and associated shaft 100 are eccentrically mounted to member 84 by a suitable hub member (not shown).

In operation, in connection with the gumming apparatus 10 previously mentioned, an adhesive carrying surface 142 of the gum roller 60 passes through the adhesive pan 88 and an adhesive 156 contained in the pan and carries a portion of the adhesive out of the pan. The metering roller 58 is provided or adjusted to give a desired gap 144, thereby returning excess adhesive to the pan. A surface 146 of the metering roller 58 skids across the gum roller at a desired distance and returns excess adhesive to the pan 88.

The excess adhesive returns to the pan 88 in what may be described as a waterfall of adhesive. In a preferred embodiment the meter roller is placed as near as possible to the surface of the adhesive 156. The closer to the surface of the adhesive, the less foaming and frothing that occurs. To better understand the foaming problem, typical latex adhesives are a white milky fluid that will foam when agitated much like an egg white when beaten. When adhesive foaming gets out of control it is typical that the foam and adhesive will overflow the pan 88.

A typical adhesive pan is approximately 1½" deep and the gum roll is placed within approximately ⅛" of the bottom of the pan 88. This should reduce foaming as the gum roller passes through the adhesive 156.

The meter roller 58 rotates in the opposite direction as the gum roller 60 and skids across the gum roller surface returning the excess adhesive to the pan 88. The meter roller eccentric adjustment allows the optimum skidding effect. The optimum adjustment of the meter and gum rollers has been observed to produce a corduroy effect whereby the adhesive remaining on the gum roller produces a series of parallel grooves on the gum roller and around the circumference of the gum roller.

The wiper roller 62 rotates in the same direction as the gum roller 60. The present invention is intended to operate at roller speeds in excess of conventional rollers. In one embodiment the gum roller operates at a rotational speed of approximately 150 r.p.m. and a preferred gear train rotates the meter roll at approximately 38 r.p.m. and the wiper roll at approximately 300 r.p.m., while the gummer cylinder at approximately 150 r.p.m. increases workpiece output since it sized in the illustrated embodiment to approximately twice the diameter of the wiper or the gum rolls. The wiper roll transfers the adhesive to the gummer cylinder in the corduroy or corrugated pattern when optimally adjusted on its eccentric.

While specific embodiments have been shown and described, many variations are possible. The eccentric mounting of the gears and shafts is a preferred feature. However, since all of these members can be removed, then the desired adjustments can be accomplished by changing the gears and rollers. It will be understood that those skilled in the art have the ability to determine the desired roller diameters of eccentric adjustments to provide desired operation of this invention.

Having described the invention in detail, those skilled in the art will appreciate that modifications may be made of the invention without departing from its spirit. Therefore, it is not intended that the scope of the invention be limited to the specific embodiments illustrated and described. Rather, it is intended that the scope of this invention be determined by the appended claims and their equivalents.

What is claimed is:

1. A method for applying a uniform adhesive layer to a moving workpiece, comprising the steps of:

providing adhesive in a container;

rotating a first roller means through the adhesive in the container, the first roller means rotated in a first direction;

transferring at least a portion of the adhesive from the container to the first roller means;

rotating a second roller means in a second rotational direction, the second roller means skidding across an adhesive coating on the first roller means, the first roller means and the second roller means moving in the same direction at their line of contact; and returning excess adhesive to the container from the line of contact between the first roller means and the second roller means as a result of the skidding contact between the first roller means and the second roller means at their line of contact without substantially foaming the adhesive.

2. A method set forth in claim 1 further comprising the steps of:

rotating a third roller means in the same direction relative to the first roller means, the first roller means and the third roller means moving in opposite directions at their line of contact; and transferring the adhesive from the first roller means to the third roller means at their line of contact.

3. A method set forth in claim 2 further comprising the steps of:

rotating a gummer roll in an opposite direction relative to the third roller means, the gummer roll and the third roller means moving in the same direction at their line of contact; and moving the workpiece in the same direction relative to the gummer roll for contact between the gummer roll and the workpiece, the workpiece and the gummer roll moving in the same direction at their line of contact.

4. A method as set forth in claim 3 further comprising the steps of:

rotating the first roller means at approximately 150 revolutions per minute;

rotating the second roller means at approximately 38 revolutions per minute; and rotating the gummer roll for applying the adhesive to the workpiece, the gummer roll means rotating at approximately 150 revolutions per minute.

5. A method for applying an adhesive to a workpiece comprising the steps of:

providing a reservoir of an adhesive;

rotating at least two cylinders that are rotating and coming into skidding contact with each other;

transferring a portion of the adhesive from the reservoir to one of the rotating cylinders;

the rotating cylinders returning the excess adhesive to the reservoir when the rotating cylinders come into skidding contact with each other; and transferring the adhesive from the one rotating cylinder to another rotating cylinder and ultimately transferring the adhesive to the workpiece.

6. A method as set forth in claim 5 including:

a method for metering the amount of adhesive transferred from the reservoir to a carrier transfer means; and the metering means in skidding contact with the carrier transfer means; and returning excess adhesive portion to the reservoir.

7. A method for applying adhesive to a workpiece where the workpiece is transferred to and from the area where adhesive is applied, the method of applying adhesive comprising the steps of:

providing an adhesive reservoir containing an adhesive;

a first rotating cylinder associating with the reservoir and the adhesive contained in the reservoir;

rotating first cylinder for progressing through the adhesive reservoir and accumulating adhesive;

contacting a second rotating cylinder with the first rotating cylinder in skidding contact;

the skidding contact providing that the excess adhesive means is returned to the adhesive reservoir, without substantial foaming of the adhesive;

contacting a third rotating cylinder with the adhesive on the first rotating cylinder and transferring at least a portion of the adhesive from the first rotating cylinder to the third rotating cylinder;

rotating a gummer roll in contact with the third rotating cylinder;

transferring at least a portion of the adhesive from the third rotating cylinder to the gummer roll; and transferring at least a portion of the adhesive from the gummer roll to a workpiece.

8. A method for applying adhesive to a workpiece as set forth in claim 7 including a method for returning a waterfall of excess adhesive to the reservoir by the first and second rotating cylinders, the first rotating cylinder moving relatively faster than the second.

9. A method for applying adhesive to a workpiece as set forth in claim 7 further including the driving of the first rotating cylinder, by a motive means, in a first rotational direction.

10. A method for applying adhesive to a workpiece as set forth in claim 7 further including the driving of an adhesive transfer rotating cylinder by an associated motor means.

11. A method for applying adhesive to a workpiece as set forth in claim 9 including operating the first and second rotating cylinders by transmitting rotational motion to the first and the second cylinders such that the second cylinder rotates in a direction opposite to the direction of rotation of the first rotating cylinder whereby the first cylinder and the second cylinder means move in the same direction at their line of contact because the first cylinder and the second cylinder rotate in opposite directions.

12. A method for applying adhesive to a workpiece as set forth in claim 11 including setting and defining the speed between the first and second rotating cylinders, where the rotational transfer means is providing a greater rotational speed for the first rotating cylinder than for the second rotating cylinder, and the ratio of rotational speed between the rotating cylinders is approximately the inverse of the ratio of the diameters of the cylinders.

13. A method for applying adhesive to a workpiece as set forth in claim 11 including the step of transmitting the rotational motion through the use of a plurality of gears and associated shafts.

14. A method for applying adhesive to a workpiece as set forth in claim 9 that further includes a method for adjusting the rotational speed of the first motive means and adjusting the speed of the associated first rotating cylinder.

15. A method for applying adhesive to a workpiece as set forth in claim 7 including stationing the gumming procedure in an envelope gumming apparatus.

16. A method for applying adhesive to a workpiece as set forth in claim 13 including the steps of:

mounting the gear members and their associated shafts eccentrically; and adjusting the adjacent rotating cylinders appropriately.

17. A method for applying adhesive to a workpiece as set forth in claim 13 further including a method for allowing a plurality of gear ratios between the first and second rotating cylinders by mounting changeable gear members associated with the first and second rotating cylinders.

* * * * *